US007187855B2

(12) United States Patent
Kaastra

(10) Patent No.: US 7,187,855 B2
(45) Date of Patent: Mar. 6, 2007

(54) DEVICE FOR HEATING LIQUIDS AND ASSEMBLY FOR USE IN SUCH A DEVICE

(75) Inventor: Simon Kaastra, Dinxperlo (NL)

(73) Assignee: Ferro Techniek Holding B.V. (NL)

( * ) Notice: Subject to any disclaimer, the term of this patent is extended or adjusted under 35 U.S.C. 154(b) by 0 days.

(21) Appl. No.: 10/541,713

(22) PCT Filed: Dec. 11, 2003

(86) PCT No.: PCT/NL03/00879

§ 371 (c)(1),
(2), (4) Date: Dec. 1, 2005

(87) PCT Pub. No.: WO2004/063637

PCT Pub. Date: Jul. 29, 2004

(65) Prior Publication Data

US 2006/0159435 A1 Jul. 20, 2006

(30) Foreign Application Priority Data

Jan. 10, 2003 (NL) ..... 1022347

(51) Int. Cl.
*F24H 1/20* (2006.01)

(52) U.S. Cl. ..... 392/456; 392/451

(58) Field of Classification Search ..... None
See application file for complete search history.

(56) References Cited

U.S. PATENT DOCUMENTS

| | | | | |
|---|---|---|---|---|
| 3,934,643 | A | 1/1976 | Laing | |
| 4,246,466 | A * | 1/1981 | Rice et al. | 392/341 |
| 4,575,615 | A * | 3/1986 | Shigenobu et al. | 392/450 |
| 4,641,012 | A * | 2/1987 | Roberts | 392/451 |
| 4,803,343 | A | 2/1989 | Sotani et al. | |
| 5,190,025 | A * | 3/1993 | Chen | 126/19.5 |
| 5,838,879 | A * | 11/1998 | Harris | 392/451 |
| 5,850,503 | A | 12/1998 | Onken | |
| 6,173,118 | B1 * | 1/2001 | Harris | 392/451 |
| 6,577,817 | B2 * | 6/2003 | Harris | 392/481 |
| 2002/0141743 | A1 * | 10/2002 | Rixen | 392/496 |
| 2003/0007790 | A1 * | 1/2003 | Harris | 392/487 |

FOREIGN PATENT DOCUMENTS

| | | |
|---|---|---|
| DE | 559 201 C | 9/1932 |
| JP | 61 162925 A | 7/1986 |

* cited by examiner

*Primary Examiner*—Thor S. Campbell
(74) *Attorney, Agent, or Firm*—The Webb Law Firm

(57) ABSTRACT

The invention relates to a device for heating liquids, comprising: a first liquid container for liquid for heating, and a heating element connected to the first liquid container. The invention also relates to an assembly for use in such a device. Such a heating device can be applied in diverse electrical appliances for heating liquids.

12 Claims, 1 Drawing Sheet

DEVICE FOR HEATING LIQUIDS AND ASSEMBLY FOR USE IN SUCH A DEVICE

BACKGROUND OF THE INVENTION

1) Field of the Invention

The invention relates to a device for heating liquids, comprising a first liquid container, a second liquid container, which second liquid container is at least partially filled with an intermediary liquid, and a heating element coupled to the second liquid container, wherein heat transfer from the heating element to the liquid for heating takes place at least substantially via the intermediary liquid. The invention also relates to an assembly for use in such a device.

2) Description of the Related Art

Devices for heating liquids have been known for a long time. The applications of these devices can also be very diverse in nature. Such heating devices are thus already applied for instance as, or as component, in water kettles, dish washers, washing machines, coffee-making machines and the like. A known drawback of the known devices which are (partially) adapted to heat liquids is the deposition of contaminants, such as limescale and soap residues and the like, on the heating element. The heat transfer from the heating element to the liquid for heating is considerably impeded by the deposition of contaminants on the heating element. Heating of the liquid to a desired temperature will therefore generally require more time and energy, which is costly and may be accompanied by overheating of the heating element.

An improved heating device is disclosed is the U.S. Pat. No. 4,803,343, comprising a container for a liquid to be heated, an elongated receiver partially filled with a working fluid, and a heating element substantially positioned within said receiver. During operation, the heating element will evaporate the working fluid to vapour bubbles which bubbles will subsequently condense at a wall of the receiver, thereby generating condensation heat for heating the liquid. Heating of the liquid for heating via the working fluid has the substantial advantage that the heating element per se remains substantially unaffected, since direct physical contact between the heating element and the liquid for heating is prevented. However, heating a liquid by means of this device has as major drawback to pass off relatively slowly, wherein a considerable amount of energy is required to initiate (sufficient) bubble formation to heat the liquid to a desired temperature.

The invention has for its object to provide an improved heating device with which a liquid can be heated in a relatively quick and energy-saving manner.

SUMMARY OF THE INVENTION

The invention provides for this purpose a device for heating liquids, characterized in that an underpressure is present in the second liquid container at room temperature. By applying an underpressure in the second container at room temperature, the boiling point of the intermediary liquid is reduced and thus enhances vapour bubble formation, and therefore also the heat transfer. In this manner liquids can be heated in a relatively quick and energy-saving manner. As mentioned before heating of the liquid for heating via the intermediary liquid has the substantial advantage that the heating element per se remains substantially unaffected, since direct physical contact between the heating element and the liquid for heating is prevented. No deposition on the heating element of components present in the liquid for heating will therefore occur. The fact that the heating element remains unaffected generally has the result that at least a substantial part of the heat produced by the heating element will be transferred to the intermediary liquid. The intermediary liquid will then (partially) evaporate to an intermediary gas fraction formed by vapour bubbles, whereafter the vapour bubbles will then rise via or through the intermediary liquid and subsequently condense at a relatively cool location, i.e. generally at the position of the first liquid container, while generating condensation heat to the liquid for heating. It is noted that the liquid for heating can be of very diverse nature. Water for instance can thus be heated using the device according to the invention, but also oil or other liquids which may or may not be viscous, and dispersions (such as an emulsion or suspension). It is also possible to heat solids, such as food, present in the liquid using the device according to the invention. The heating element will usually only be in contact with the relatively pure intermediary liquid. Direct physical contact between the heating element and the intermediary liquid is not however essential. A relatively good thermal contact is however essential. By applying a heating element which is at least substantially always clean a maximum heat transfer will therefore always be possible from heating element to intermediary liquid. Furthermore, as the heating element remains relatively clean after (frequent) use, the lifespan of a heating element applied according to the invention is generally much greater. It will be possible to only partially fill the second liquid container with the intermediary liquid, and a remaining part of the liquid container will be formed by an intermediary gas, in particular intermediary vapour, corresponding to the intermediary liquid. During operation of the device the intermediary liquid in the second liquid container is heated by the heating element, whereby evaporation of (a part of) the intermediary liquid will take place. The resulting intermediary vapour will condense against the relatively cool second liquid container and generate condensation heat. The heat absorbed by the second liquid container is then relinquished to the liquid for heating received in the first liquid container. Vapour formation or gas formation in the intermediary liquid thus plays an important part during the heat transfer from the heating element to the liquid for heating. It is noted that the amount of intermediary liquid is preferably sufficient to prevent the heating element boiling dry, also for instance in the case the device is in inclining position. In the case for instance no underpressure is applied in the second liquid container, the intermediary gas (vapour) in equilibrium with the intermediary liquid can also form part of a different gas, such as atmospheric air.

In a preferred embodiment, the second liquid container forms a physical separation between the heating element and the first liquid container. As already noted, the intermediary liquid may or may not be in contact with the heating element. The design of both the heating element and the second liquid container can be very diverse and depends particularly on the application of the device. In a particular preferred embodiment, the heating element is at least substantially enclosed by the second liquid container. This particular preferred embodiment is generally advantageous since (almost) all, or at least a large part, of the heat produced by the heating element can be absorbed by the intermediary liquid, whereby the heat transfer efficiency can be optimized.

The intermediary liquid is preferably formed at least substantially by water, in particular relatively pure water.

Since deposition of components present in the intermediary liquid has to be prevented, or at least countered, the intermediary liquid has to be at least substantially free of ions or other dispersed particles which form a precipitate relatively quickly in increased temperature conditions. It is however also possible to envisage the use of other liquids as well as water.

In a preferred embodiment, the second liquid container is at least partially deformable, particularly at a relatively high temperature of the intermediary liquid. Since the second liquid container generally becomes relatively warm during use of the device, deposition of components present in the liquid for heating, such as limescale, can also take place on the second liquid container. By giving the second liquid container a (slightly) flexible form, precipitate formed or the second liquid container can be loosened by vibration and long-term deposition on the second liquid container can be prevented, or at least countered. Deforming of the second liquid container can for instance be realized by vapour bubbles formed in the intermediary liquid which 'collide' with the second liquid container, whereby it will begin to vibrate. It is however also possible to envisage manufacturing the second liquid container from material which deforms reversibly at transitions in temperature. An additional advantage of causing slight deformation and at least partial vibration of the second liquid container is that vapour bubbles formed in the intermediary liquid can hardly remain 'attached' to the second liquid container. This phenomenon is also referred to as 'vapour lock'. Clinging of the vapour bubbles to the second liquid container generally reduces the heat-transferring capacity of the second liquid container considerably.

In another preferred embodiment the heating element is positioned at a distance from the first liquid container. Such a positioning of the heating element has the advantage that a seal positioned between the heating element and the first liquid container can be arranged at a relatively cool position, and thus at a distance from the heating element. The seal will herein not degenerate, or hardly so, as a result of the only small thermal fluctuations, which generally enhances the lifespan.

In yet another preferred embodiment, the device is provided with a safety provision to prevent overheating of the device. This safety provision can for instance be formed by a temperature sensor in the heating element, a steam sensor or a pressure sensor in the second liquid container. In addition, it is also conceivable to measure the deformation, optionally per unit of time, of the second liquid container as a measure for the temperature prevailing in the intermediary vapour.

The second liquid container is preferably provided at least partially with a profiled surface. By giving the surface of the second liquid container a profiled, in particular ribbed form, the contact surface of the second liquid container with the liquid for heating is enlarged, whereby the heat absorbed by the second liquid container can be generated more efficiently to the liquid for heating. It is however also possible to envisage providing the second liquid container with one or more protruding parts in order to enlarge the contact surface, and thereby the heat transfer per unit of time, of the second liquid container with respectively to the liquid for heating.

The second liquid container preferably takes an at least substantially rod-like form. A rod-like second liquid container generally has the property of being relatively pressure-resistant. A second liquid container of other form can also be applied in addition to a rod-like second liquid container.

In a preferred embodiment the second liquid container is manufactured at least partially from a relatively smooth stainless steel. Deposition on the second liquid container of precipitate from the liquid for heating can be prevented, or at least countered, by applying a second liquid container manufactured from a relatively smooth stainless steel, whereby the heat transfer from the second liquid container to the liquid for heating will not generally be impeded by precipitate. A second liquid container manufactured from smooth stainless steel is moreover usually relatively simple to clean. In addition to stainless steel, it is also conceivable to apply other temperature-resistant materials for manufacture of the second liquid container, which materials are preferably also provided with a surface which prevents, or at least counters, adhesion of solids.

In a preferred embodiment the heating element is connected non-releasably to the second liquid container. The non-releasable connection can for instance be realized by a welded connection. Before the second liquid container is sealed medium-tightly, it is filled, preferably partially, with the intermediary liquid and an underpressure is optionally applied in the second liquid container. In another preferred embodiment however, the second liquid container is connected releasably to the heating element. Such a preferred embodiment makes it possible to replace or clean the intermediary liquid and/or the second liquid container after a determined period of time. Such a preferred embodiment furthermore makes it possible in simple manner to carry out maintenance work on the heating element. A seal is preferably arranged between the second liquid container and the heating element in order to seal the second liquid container medium-tightly. The seal can for instance be formed by a rubber ring.

The invention also relates to an assembly of a heating element and a second liquid container for use in the above stated device. The assembly can then be fitted in a first liquid container to form the device according to the invention.

BRIEF DESCRIPTION OF THE DRAWINGS

The invention will be elucidated with reference to non-limitative exemplary embodiments shown in the following figures, in which.

DETAILED DESCRIPTION OF THE PREFERRED EMBODIMENTS

Figure 1:
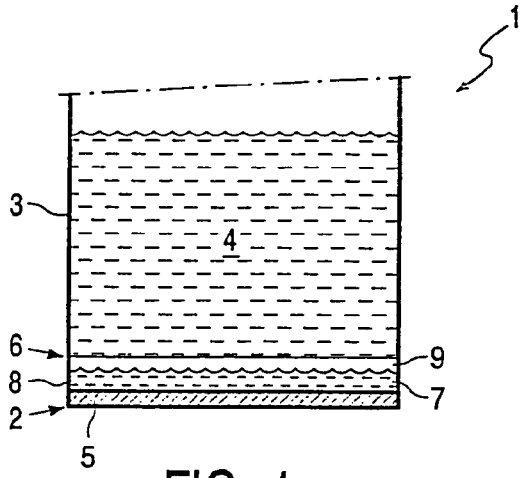
FIG. 1 shows a cross-section of a first embodiment of a water kettle provided with a heating device according to the invention.

FIG. 1 shows a cross-section of a first embodiment of a water kettle 1 provided with a heating device 2 according to the invention. Water kettle 1 comprises a first liquid container 3 for water for heating 4. Heating device 2 comprises a heating element 5 and a second liquid container 6 provided with an intermediary liquid 7. As shown clearly in FIG. 1, the second liquid container 6 forms a physical separation between heating element 5 and the water for heating 4 in the first liquid container 3. Heating of water 4 will thus always take place by means of heat transfer from heating element 5 to the water for heating 4 via the second liquid container 6 and the intermediary liquid 7 received therein. In this manner deposition of the components present in the water for heating 4, such as for instance deposition of limescale, on heating element 5 can be prevented. The great advantage hereof is that the capacity (progression) of heating element 5, and thus of water kettle 1, to transfer heat to the water 4 for heating remains at least substantially constant. It is however essential that a relatively pure intermediary liquid 7 is applied, in order to prevent, or at least minimize, deposition of the components present in intermediary liquid 7. The second liquid container 6 is provided with an at least substantially fully closed housing 8, which housing 8 is partially filled with intermediary liquid 7. An intermediary gas fraction 9, in particular a vapour phase of intermediary liquid 7, will therefore always be present above intermediary liquid 7. An underpressure is preferably applied in the second liquid container 6. The advantages of an applied underpressure have already been described above. A variety of liquids, such as for instance water, alcohol and oil, can be applied as intermediary liquid 7. As will be apparent, the intermediary liquid 7 in the shown embodiment is not in physical contact with heating element 5, but is however in good thermal contact. The intermediary liquid 7 will thus be heated via housing 8 by heating the heating element 5. The relatively warm housing 8 and intermediary liquid 7 then transfer heat (in small measure) to the water for heating 4. With sufficient heating of intermediary liquid 7, vapour bubbles will be formed in intermediary liquid 7 close to heating element 5. The vapour bubbles will subsequently rise and eventually collide with a part of housing 8. Upon this collision the formed vapour bubbles will condense while relinquishing condensation heat to a part of housing 8 in contact with the water for heating 4. The heating of a liquid by means of condensation heat is generally relatively efficient. Housing 8 can be manufactured from diverse materials or from a combination of materials. At least a part of housing 8 in contact with the water for heating 4 preferably takes a slightly thin-walled and flexible form. Precipitate deposited on a side of housing 8 remote from the intermediary liquid 7 will generally be removed as a result of vibrations of housing 8 caused by the collision with housing 8 of vapour bubbles from intermediary liquid 7. It is also possible to envisage manufacturing housing 8 from a material with a relatively high coefficient of expansion. As a consequence of temperature change, material deformation (expansion or contraction) of housing 8 will then take place relatively quickly, whereby precipitate deposited on housing 8 will usually also be removed from housing 8 independently. In this manner the heating device 2 thus acquires a kind of self-cleaning capability.

Figure 2:
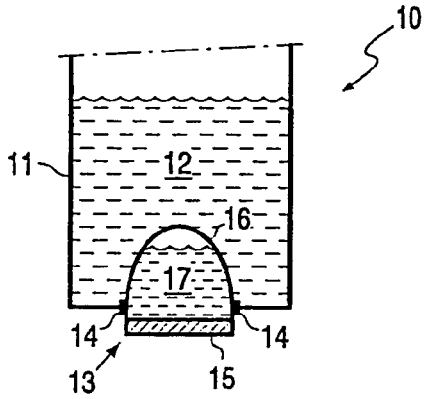
FIG. 2 shows a cross-section of a second embodiment of a water kettle provided with a heating device according to the invention.

FIG. 2 shows a cross-section of a second embodiment of a water kettle 10 provided with a heating device according to the invention. Water kettle 10 comprises a first liquid container 11 for water to be heated 12, and a heating device 13 for heating the water to be heated 12. Heating device 13 is arranged in an opening arranged in the first liquid container 11. For sufficient sealing of this opening the heating device 13 is positioned in the opening with clamping fit and via a sealing ring 14. Heating device 13 comprises a heating element 15 and a boiler 16 connected to heating element 15, which boiler 16 is partially filled with an intermediary liquid 17. Other than in FIG. 1, the intermediary liquid 17 is now in direct (physical) contact with heating element 15. Boiler 16 takes a substantially conical form and is preferably manufactured from a material which allows reversible deformation during temperature fluctuations. Examples of such materials can be for instance plastic or metal. Deformation of boiler 16, or at least a part thereof, during temperature fluctuations prevents deposition of scale (precipitate) on boiler 16 from the water to be heated 12. In the shown embodiment the heating element 15 lies at a distance from the first liquid container 11, which is generally particularly advantageous since the sealing ring 14 is then also positioned at a distance from heating element 15, and thus at a relatively cool location. Sealing ring 14 usually degenerates relatively rapidly with considerable temperature fluctuations, which is now largely prevented. The operation of the water kettle 10 shown in FIG. 2 corresponds substantially to that of the water kettle 1 shown in FIG. 1. It will therefore not be described further here.

Figure 3:
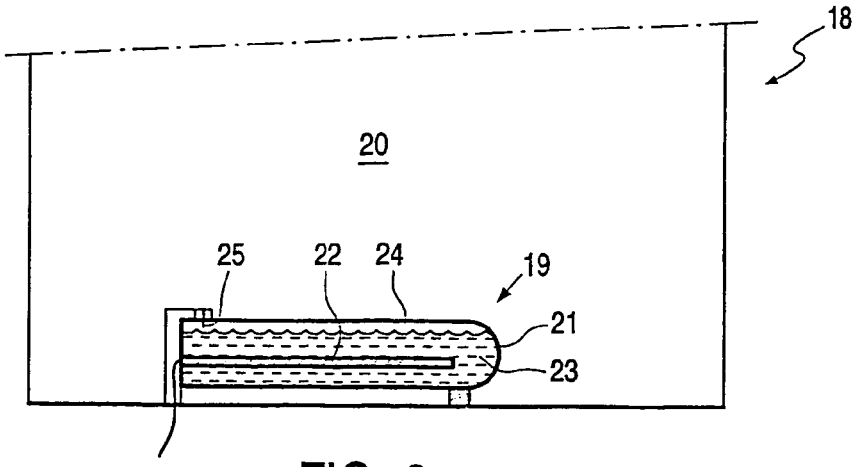
FIG. 3 shows a cross-section of a first embodiment of a dish washer provided with a heating device according to the invention.

FIG. 3 shows a cross-section of a first embodiment of a dish washer 18 provided with a heating device 19 according to the invention. Heating device 19 is positioned at least substantially wholly in a washing chamber 20 of dish washer 18. Heating device 19 comprises an at least substantially cylindrical second liquid container 21 and a heating element 22 positioned at least substantially co-axially in the second liquid container 21. The second liquid container 21 is partially filled with an intermediary liquid 23 and the remaining part is filled with an intermediary gas fraction 24 corresponding with the intermediary liquid 23. A pressure sensor 25 is arranged in intermediary gas fraction 24 to prevent overload of heating device 19. Heating element 22 is connected to a voltage supply (not shown). Heating device 19 is adapted such that the second liquid container 21 is connected releasably to heating element 22, so as to enable maintenance operations or replacement of components. Heating element 22 now takes a rod-like form. It is likewise possible to envisage using heating elements of other form, such as for instance spiral-shaped, plate-like and strip-like heating elements. It should be apparent that the heating device according to the invention can be used in numerous applications and can be of very varied design.

The invention claimed is:

1. A device for heating liquids, comprising:

a first liquid container for liquid for heating, a second liquid container, which second liquid container is at least partially filled with an intermediary liquid, and a heating element coupled to the second liquid container, wherein heat transfer from the heating element to the liquid for heating takes place at least substantially via the intermediary liquid, and wherein the intermediary liquid is formed at least substantially by water, wherein an underpressure is present in the second liquid container at room temperature.

2. The device as claimed in claim 1, wherein the second liquid container is at least partially deformable at a relatively high temperature of the intermediary liquid.

3. The device as claimed in claim 1, wherein the second liquid container forms a physical separation between the heating element and the first liquid container.

4. The device as claimed in claim 1, wherein the heating element is at least substantially enclosed by the second liquid container.

5. The device as claimed in claim 1, wherein the heating element is positioned at a distance from the first liquid container.

6. The device as claimed in claim 1, wherein the device is provided with a safety provision to prevent overheating of the device.

7. The device as claimed in claim 1, wherein the second liquid container is provided at least partially with a profiled surface.

8. The device as claimed in claim 1, wherein the second liquid container takes an at least substantially rod-like form.

9. The device as claimed in claim 1, wherein the second liquid container is manufactured at least partially from a relatively smooth stainless steel.

10. The device as claimed in claim 1, wherein the heating element is connected non-releasably to the second liquid container.

11. The device as claimed in claim 1, wherein the second liquid container is connected releasably to the heating element.

12. The device as claimed in claim 1, wherein a seal is arranged between the second liquid container and the heating element.

* * * * *